US007396073B2

(12) United States Patent
Zheng

(10) Patent No.: US 7,396,073 B2
(45) Date of Patent: Jul. 8, 2008

(54) COLLAPSIBLE MOON CHAIR

(75) Inventor: Edward Zheng, Chino Hills, CA (US)

(73) Assignee: Tofasco of America, Inc., LaVerne, CA (US)

( * ) Notice: Subject to any disclaimer, the term of this patent is extended or adjusted under 35 U.S.C. 154(b) by 0 days.

(21) Appl. No.: 11/568,732

(22) PCT Filed: May 6, 2004

(86) PCT No.: PCT/US2004/014275

§ 371 (c)(1),
(2), (4) Date: Jul. 11, 2007

(87) PCT Pub. No.: WO2005/112700

PCT Pub. Date: Dec. 1, 2005

(65) Prior Publication Data

US 2007/0267901 A1 Nov. 22, 2007

(51) Int. Cl.
*A47C 4/00* (2006.01)

(52) U.S. Cl. ..... 297/16.1; 297/16.2; 297/17; 297/46; 297/44; 297/452.13

(58) Field of Classification Search ..... 297/16.1, 297/16.2, 17, 42, 44, 45, 46, 49, 452.13
See application file for complete search history.

(56) References Cited

U.S. PATENT DOCUMENTS

| | | | | |
|---|---|---|---|---|
| 3,511,503 | A | 5/1970 | Volpe | |
| 3,964,790 | A | 6/1976 | Bergeron | |
| 5,921,621 | A | 7/1999 | Cook et al. | |
| 5,984,406 | A | 11/1999 | Lee | |
| 6,082,813 | A | 7/2000 | Chen | |
| 6,302,479 | B1 | 10/2001 | Zheng | |
| 6,406,091 | B1 * | 6/2002 | Saul et al. | 297/16.2 |
| 6,447,057 | B1 * | 9/2002 | Chen | 297/16.2 |
| 6,607,240 | B2 | 8/2003 | Zheng | |
| 6,637,811 | B2 | 10/2003 | Zheng | |
| 6,702,371 | B2 * | 3/2004 | Zheng | 297/16.2 |
| 6,848,740 | B1 * | 2/2005 | Reese | 297/16.1 |
| 6,883,862 | B1 * | 4/2005 | Yao | 297/16.1 |
| 6,957,852 | B1 * | 10/2005 | Hsieh | 297/46 |

* cited by examiner

*Primary Examiner*—Laurie K. Cranmer
(74) *Attorney, Agent, or Firm*—Fish & Associates, PC

(57) ABSTRACT

A moon chair is configured to collapse in a single movement in which a seat frame is folded while the legs approximate each other. Contemplated moon chairs particularly include those that can be collapsed without separating the seat portion form the leg portion.

14 Claims, 2 Drawing Sheets

COLLAPSIBLE MOON CHAIR

FIELD OF THE INVENTION

The field of the invention is collapsible chairs, and particularly to collapsible moon chairs.

BACKGROUND OF THE INVENTION

Numerous folding chairs are relatively popular, in part because they can be stored with considerably reduced space requirements when compared to non-folding chairs. Nevertheless, folding chairs still require relatively large space, since the dimension of the folding chair is generally reduced only along one space coordinate (e.g., reduced length). To further reduce the space requirement, collapsible chairs have been developed, in which further size reduction is achieved by folding the chair along at least two space coordinates (e.g., length and width). Various collapsing chairs are known in the art.

For example, Cook et al. describes in U.S. Pat. No. 5,921,621 a collapsible chair with a foldable backrest, in which the chair has four legs that support the corners of a flexible, square seat. The legs are movably attached to each other at about their respective midpoints, and the seat is collapsed in width and depth by turning the legs around the midpoint. While Cooks chair is relatively easy to unfold and collapse, Cook's chair provides relatively little stability and is prone to tipping over. Improved stability can be achieved by including slidable cross bars between the legs as described in U.S. Pat. No. 6,082,813 to Chen and U.S. Pat. No. 5,984,406 to Lee. Still further improved chairs with tensioned seats, solid armrests, and/or other advantages over previously known collapsible chairs are described by Zheng in U.S. Pat. Nos. 6,637,811, 6,607,240, and 6,302,479.

However, where the chair has an inverted calotte-shaped seat (a.k.a., moon chair or, Papason chair), collapsing of such a often chair becomes problematic. Therefore, most of such chairs are not collapsible at all, or can only be disassembled into the seat portion and one or more legs as, for example, described in U.S. Pat. No. 3,511,503 to Volpe or U.S. Pat. No. 3,964,790 to Bergeron. More recently, moon chairs have been commercially available (MAC Sports, Medium Moon Chair) in which the seat portion has a ring-shaped frame that is detachably coupled to a foldable leg portion, wherein both the ring-shaped frame and the leg portion are foldable when separated from each other. However, while such folding chairs generally provide a significant improvement in terms of reduced space requirement when not in use, several problems nevertheless remain. Most notably, the folding operation is often cumbersome as partial disassembly is required prior to folding the chair.

Therefore, while there are numerous moon chairs known in the art, all or almost all of them suffer from one or more disadvantages. Consequently, there is still a need to provide improved configurations and methods for collapsible moon chairs.

SUMMARY OF THE INVENTION

The present invention is directed to a collapsible moon chair in which the leg portion and the seat portion are collapsed/folded in a single motion while the seat portion remains coupled to the leg portion.

In one aspect of the inventive subject matter, a collapsible moon chair has a seat that is coupled to a ring-shaped frame having a plurality of flexible elements that are configured to allow folding of the ring-shaped frame. A quad structure, preferably comprising four cross braces, is coupled to the seat wherein at least one of the cross braces is coupled to the ring-shaped frame via a foldable element such that the moon chair collapses in a single movement from an open configuration to a closed configuration.

It is especially preferred that the flexible elements in such chairs are configured such that the frame collapses in a manner that positions a first and a second portion of the seat in substantially parallel position when the chair is in the closed configuration, and that at least a portion of the quad structure is located between the first and second portions when the chair is in the closed configuration. In further preferred aspects, the foldable element comprises a first rod that is pivotably coupled to a second rod, wherein the first rod is (e.g., pivotably) coupled to the frame, and wherein the second rod is (e.g., slidably and pivotably) coupled to the cross brace.

In another aspect of the inventive subject matter, a collapsible includes a ring-shaped frame that is segmented by a plurality of hinges into a first and a second long arch, and a first and a second short arch, wherein the first and second long arches are movably coupled to the first and a second short arches. Such chairs further include a quad structure comprising four cross braces, wherein one of the cross braces is movably coupled to the first and second long arches via a pair of foldable elements, and wherein another cross brace is movably coupled to the first and second long arches such that the moon chair collapses in a movement in which the first and second long arches approximate each other when the first and second cross braces approximate each other.

The foldable element in such chairs preferably comprises a first and a second rod, in which the each of the first rods is pivotably coupled to the first and second long arches, respectively, and wherein each of the second rods is slidably and pivotably coupled to the first of the cross braces. Contemplated chairs may further include a first and second element that are coupled to the first and second long arches, respectively, and cooperate to form a handle with which the chair is carried when the chair is in a closed configuration.

Various objects, features, aspects and advantages of the present invention will become more apparent from the following detailed description of preferred embodiments of the invention, along with the accompanying drawing, in which like numerals represent like components.

DETAILED DESCRIPTION

The inventors discovered that a moon chair can be constructed that can be collapsed in a single movement in which the seat frame is folded while the legs approximate each other. It should be particularly appreciated that such moon chairs can be collapsed without separating the seat portion form the leg portion.

Figure 1:
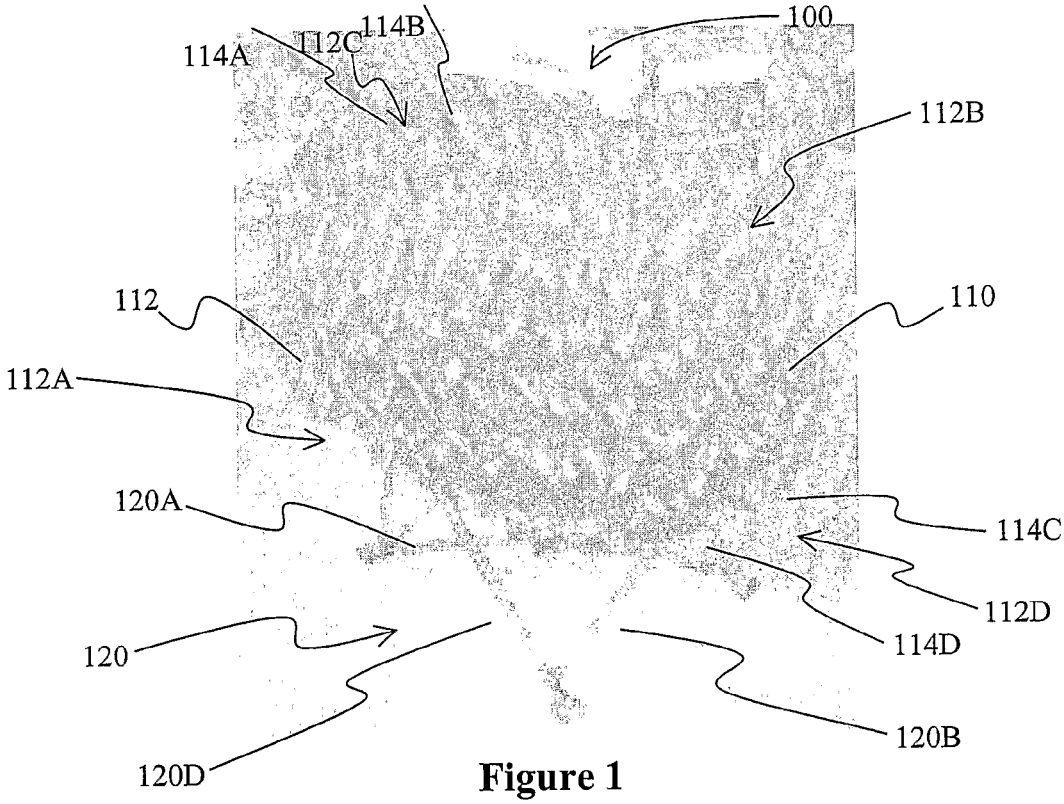
FIG. 1 is a perspective view of an exemplary collapsible moon chair according to the inventive subject matter in open configuration.
Figure 5:
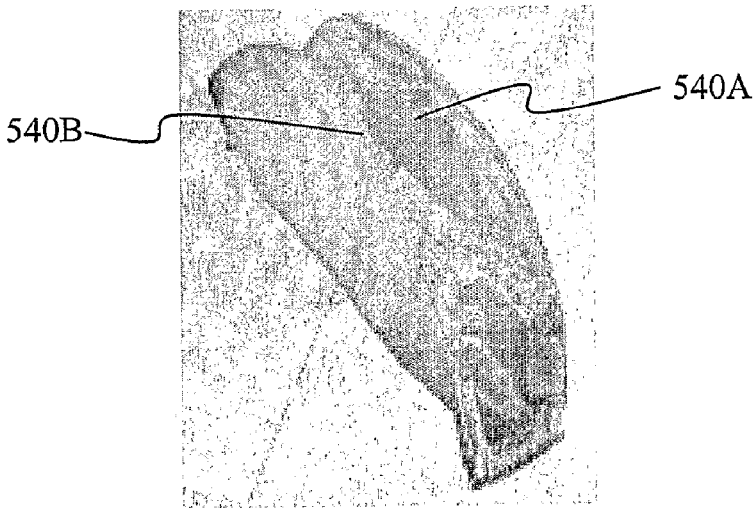
FIG. 5 is a perspective view of the chair of FIG. 1 in collapsed configuration.

In one especially preferred example, as depicted in FIG. 1, a moon chair 100 has a seat 110 (which is continuous with a back) that is removably coupled to a ring-shaped frame 112. The ring-shaped frame 110 is divided by hinges 114A, 114B, 114C, and 114D into first and second long arches 112A and 112B, and first and second short arches 112C and 112D. Quad structure 120 has a first cross brace 120A (only partially shown, see also FIG. 2), a second cross brace 120B, a third cross brace 120C (not shown, see also FIG. 2), and a fourth cross brace 120D. Each of the cross braces comprises two cross bars, respectively, wherein the cross bars are movably coupled to each other (each cross brace typically forming an X-shaped structure). Handles 540A/540B or other elements configured to support at least part of the weight of contemplated chairs may be added to each of the long arches as depicted in FIG. 5 below.

Figure 2:
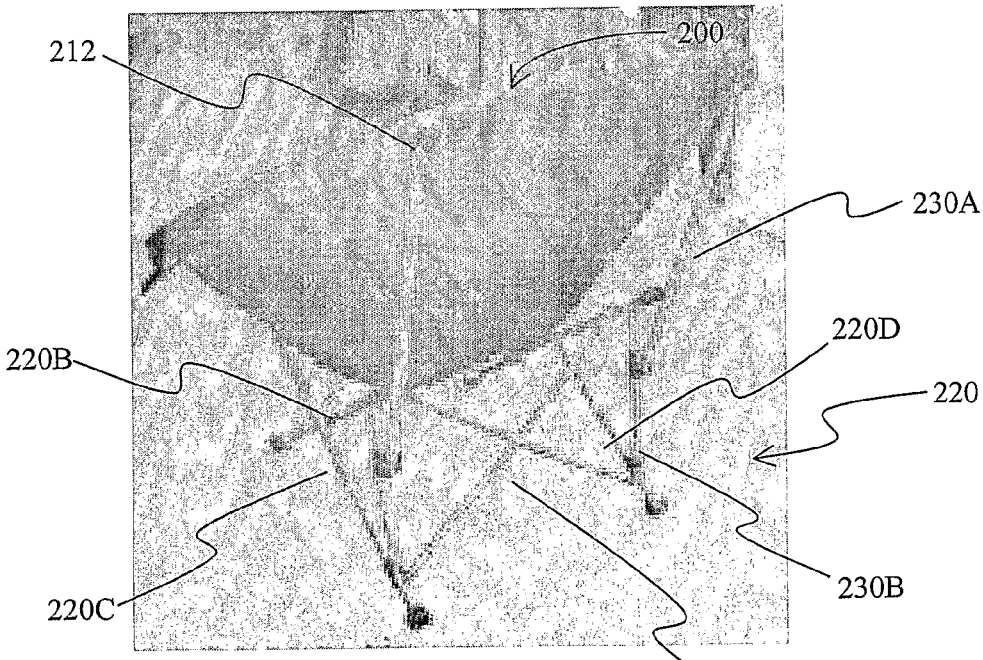
FIG. 2 is another perspective view of the chair of FIG. 1.

FIG. 2 depicts the exemplary chair of FIG. 1 in a different perspective view. In this view, it can be seen that the ring-shaped frame 212 of chair 200 is coupled to the first cross brace 220A (and cross braces 220C and D) of quad structure 220 via a foldable element that comprises first rod 230A and second rod 230B, which are pivotably coupled to each other. First rod 230A is further pivotably coupled to one of the long arches, while the second rod 230B is pivotably, and preferably also slidably, coupled to one cross bar of a cross brace 220D. Where contemplated chairs have two foldable elements, the same configuration is contemplated for the second foldable element with respect to their mutual coupling and coupling to cross brace 220C. Cross brace 220 B is further movably coupled to the cross braces 220C and D to form the quad structure.

It should be especially appreciated that both of the cross bars of cross braces 220C and 220D in preferred chairs engage with the respective foldable elements in the open configuration. Specifically, while one cross bar is slidably coupled to second rod 230B, the other cross bar is pivotably coupled to the second rod 230B and releasably engages with the first rod 230A to stabilize the chair in the open configuration. Thus, as the chair is collapsed, it should be recognized that the other cross bar releases the first rod 230A while drawing the slidable coupling towards the pivot point between the cross bars. At the same time, the first rod 230A provides for a folding motion. Therefore, the front legs and rear legs of contemplated chairs are formed by a pair of cross braces, respectively, that are disposed on the side of the chair, while the foldable elements coordinate the side-to-side collapsing motion of the legs via a second pair of cross braces (that are movably coupled to the pair of cross braces) with the folding motion of the frame.

Therefore, it is generally preferred that (a), the coupling of the cross bars of each cross brace, and (b) the coupling of the ends of the cross braces proximal to the ground on which the chair stands, are rotatable couplings to form a quad structure. Furthermore, with respect to the distal ends of the cross bars in the cross braces on the side of the chair, it is preferred that one end is pivotably coupled to the ring-shaped frame, while the other end (more typically terminal portion) is rotatably coupled to one end of the second rod of the foldable element and further releasably engages with the first rod of the foldable element (when the chair is in the open configuration). Similarly, the distal ends of the cross bars in the frontal cross brace are preferably rotatably coupled to the ring-shaped frame, while the cross bars in the rear cross brace are preferably coupled to or near the ends of the cross bars of the side cross braces.

The term "quad" or "quad structure" are used interchangeably herein and refer to a configuration that comprises a plurality of elements in which four pairs of two elements are coupled to form a polygon of four sides, wherein the two elements of each pair are rotatably coupled to each other, and at least one element of one side of the polygon is rotatably or slidably coupled to one element of another side. In especially preferred quad structures, four pairs of cross braces (with each cross brace comprising two cross bars rotatably coupled to each other and forming an X) are movably coupled to each other such that when the cross bars of one cross brace rotate relative to each other, the quad structure collapses in a single movement.

As also used herein, the term "collapses in a single movement" or "collapses in a single motion" are used interchangeably and refer to a movement in which a user need not interrupt the collapsing motion to fasten or unfasten a connector, or to remove the seat or frame from the legs or quad structure. Thus, the term "collapses in a single movement" may also include multiple sub-movements, which may or may not be separated by a pause. As still further used herein, the term "open configuration" refers to the configuration of the collapsible chair in which the front legs have a maximum distance from each other when the chair is opened using reasonable force (i.e. without damaging the mechanical structure). Similarly, the term "closed configuration" refers to the configuration of the collapsible chair in which the front legs have a minimum distance from each other when the chair is closed using reasonable force (i.e. without damaging the mechanical structure).

Figure 3:
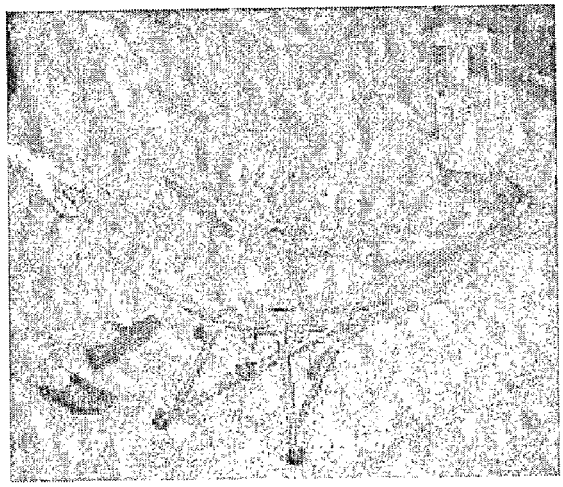
FIG. 3 is a perspective view of the chair of FIG. 1 in partially collapsed configuration.
Figure 4:
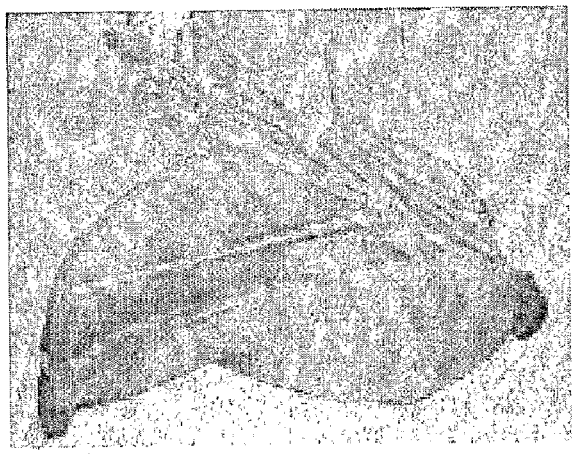
FIG. 4 is another perspective view of the chair of FIG. 1 in partially collapsed configuration.

Collapsing of the exemplary chair of FIG. 1 is depicted in FIGS. 3, 4, and 5, in which the frame folds backwards (as seen from an observer in the chair) such that at least part, and more typically all of the quad structure is disposed between the sections that are folded together. In the closed configuration, therefore, the collapsed quad structure is between two substantially parallel portions of the seat (and frame). The term "substantially parallel" means that hypothetical planes drawn through the two portions will intersect at an angle that is less than 30 degrees, more typically less than 20 degrees, and most typically less than 10 degrees.

With respect to the ring-shaped frame, it should be recognized that the particular shape of the frame is generally not limiting to the inventive concept presented herein, and numerous alternative shapes are contemplated. For example, where a relatively tall person is to be supported, the shape may be oval or ellipsoid. Similarly, where more than one person is supported, a rectangular shape may be employed. Therefore, it should be recognized that suitable frame shapes especially include those that are closed in themselves, and/or that can be folded such that a first portion of the frame approximates a second portion of the frame (preferably such that the two portions of the folded frame at least partially enclose the quad structure).

Consequently, the size of suitable frames may vary considerably, and contemplated sizes will predominantly be determined by the size and number of users. Suitable frame sizes will typically between about 0.8 meter to about 2 meters in one dimension (e.g., width) and 0.6 meter to 1.5 meter in the other dimension (e.g., height). However, larger or smaller frames are not excluded. Depending on the length of the foldable element, the angle at which the frame is positioned relative to the ground will vary. However, it is generally preferred that the angle of a hypothetical plane parallel to the frame and the ground on which the chair stands is between about 25 degrees to about 70 degrees.

In further preferred aspects, the frame will also include a number of flexible elements (preferably at least two, more preferably at least four) that allow folding of the frame. There are numerous flexible elements known in the art, and all of such elements are considered suitable for use herein. However, particularly contemplated flexible elements include hinges (e.g., manufactured from a synthetic polymer) that may optionally include a safety latch to secure the hinge in one or another position.

Suitable seats may be fabricated from numerous materials and combinations thereof, and it is generally preferred that the particular choice of materials is not limiting to the inventive concept presented herein so long as such material will allow folding of the seat. Therefore, especially suitable seat materials include natural and synthetic fibers (e.g., cotton, polyester or other weather resistant polymer (e.g., Nylon)), which may be woven or non-woven. With respect to the color, it is contemplated that suitable colors need not be restricted to uniform color, but appropriate colors may also include color patterns, prints, or no color at all. In yet farther preferred aspects, it is contemplated that the seat comprises a seat portion and backrest portion that are integrally formed from the seat material. In such a seat, an indentation or depression in a hypothetical plane formed by the frame forms both the seat and backrest portion. Alternatively, however, the seat and backrest portion may also be more pronounced and individually shaped (which are then coupled together by sewing or other manners).

While it is generally preferred that the seat according to the inventive subject matter is sized and dimensioned to fit an average adult person, it is also contemplated that appropriate chairs may also accommodate a child, a smaller- or larger-than-average adult, or more than a single person. Therefore, suitable seats will typically be coupled to the frame such that the frame surrounds the seat. It should be recognized that the seat may be coupled to the frame in numerous ways, including temporary and permanent coupling. Temporary couplings include hook-and-loop type fasteners, snaps, buckles, slidable elements (e.g., a pouch slidably coupled to a post, a ring slidably coupled to a rod, etc.), and threadbly securable elements (e.g., laces threaded through rings). Permanent couplings include sewed or glued elements. For example, the seat may be permanently coupled to the frame via a rivet.

It should further be appreciated that the attachment of the seat to the frame may be direct or indirect. As used herein, the term "direct" attachment means that the seat and/or the backrest are in immediate contact with the frame, whereas the term "indirect" means that an additional element connects the seat with the frame. For example, the seat may be directly attached to the seat support rods via a slidable pouch. Alternatively, the seat may be indirectly coupled to the seat support rods via a connector (e.g., spring) that engages with the seat and frame.

It is still further preferred that the foldable element comprises a first and a second rod, wherein the foldable element couples the frame, preferably at the long arch, with the quad structure, preferably with the rear and/or side cross brace. Therefore, it is typically preferred that the first rod is rotatably coupled to the frame on one end, while the other end is pivotably coupled to the second rod, preferably at a position between the first and second ends of the second rod. The second rod in preferred chairs is pivotably coupled to one end of a cross bar (typically the cross bar of the cross brace that is disposed at the side of the chair, and most typically also to the cross bar of the cross brace that is disposed at the rear of the chair), and further pivotable and slidably coupled to another cross bar of a cross brace at the side of the chair.

With respect to the ring-shaped frame, the cross braces, and foldable elements of contemplated chairs, it should be appreciated that all of such elements may be manufactured from various materials, including metals, metal alloys, natural and synthetic polymers, and any reasonable combination thereof. However, it is preferred that the ring-shaped frame, the cross braces, and foldable elements are manufactured from steel tubing or black anodized aluminum tubing with a wall strength of about 1/32 inch and an outer diameter of approximately 1/2 inch. Preferred alternative materials include stainless steel, fiberglass, and wood.

Where one of the arches of the frame, the cross braces, and the rods of the foldable element is pivotally coupled to another one of the arches of the frame, the cross braces, and the rods of the foldable element, it is generally contemplated that all known manners of rotatably coupling are suitable for use in conjunction with the teachings presented herein. For example, appropriate manners of rotatably coupling include coupling of two elements via a common axis, coupling via a hinge wherein the hinge may or may not have a slidable connection to another element, coupling via a ball bearing, etc. Especially contemplated rotatable couplings further include additional coupling elements that may or may not operate in a function other than rotatably coupling. For example, two cross braces may be rotatably coupled to an element that also operates as a base plate that contacts the ground when the chair is in the open configuration.

Similarly, where one of the arches of the frame, the cross braces, and the rods of the foldable element is slidably coupled to another one of the arches of the frame, the cross braces, and the rods of the foldable element, all known slidable couplings are contemplated to be appropriate, and include a sliding sleeve, slide rails, guiding rings, etc. Moreover, it should be appreciated that the coupling may very depending on the particular configuration of contemplated chairs. For example it is contemplated that all of the couplings may be rotatable, pivotable, and/or slidable. On the other hand, where slidable couplings are less desirable, alternative couplings may be employed and suitable couplings especially include telescoping connectors, temporary couplings such as snap connectors, connectors that are secured with a pin or other removable element, etc. Therefore, and with respect to the configuration of contemplated chairs, it should be recognized that numerous alternative configurations are also appropriate, so long as alternative collapsible chairs collapse in a single movement.

It should further be appreciated that in alternative aspects of the inventive subject matter the number of legs, and/or frame segments may vary considerably. For example, where the chair is sized and dimensioned to accommodate more than one person, five, six, or more legs may be included. Similarly, in such chairs the number of segments may be six, eight, or even higher.

Thus, specific embodiments and applications of improved moon chairs have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A collapsible moon chair, comprising:

a seat coupled to a ring-shaped frame, wherein the ring-shaped frame comprises a plurality of flexible elements that are configured to allow folding of the ring-shaped frame; and a quad structure comprising a plurality of cross braces, wherein at least one of the cross braces is coupled to the ring-shaped frame via a foldable element such that the moon chair collapses in a single movement from an open configuration to a closed configuration.

2. The collapsible moon chair of claim 1 wherein the plurality of flexible elements are configured such that the frame collapses in a manner that positions a first and a second portion of the seat in substantially parallel position when the chair is in the closed configuration.

3. The collapsible moon chair of claim 2 wherein at least a portion of the quad structure is located between the first and second portions when the chair is in the closed configuration.

4. The collapsible moon chair of claim 1 wherein the foldable element comprises a first rod that is pivotably coupled to a second rod, wherein the first rod is coupled to the frame, and wherein the second rod is coupled to the cross brace.

5. The collapsible moon chair of claim 4 wherein the first rod is pivotably coupled to the frame, and wherein the second rod is slidably and pivotably coupled to the cross brace.

6. The collapsible moon chair of claim 5 wherein another of the plurality of cross braces is pivotably coupled to the frame.

7. The collapsible moon chair of claim 6 further comprising a first and a second element that are coupled to the frame and cooperate form a handle for carrying the chair when the chair is in the closed configuration.

8. The collapsible moon chair of claim 1 wherein the frame is circular.

9. The collapsible moon chair of claim 1 wherein the seat is removably coupled to the frame.

10. A collapsible chair comprising:

a ring-shaped frame that is segmented by a plurality of hinges into a first and a second long arch, and a first and a second short arch, wherein the first and second long arches are movably coupled to the first and a second short arches;

a quad structure comprising four cross braces, wherein a first of the cross braces is movably coupled to the first and second long arches via a pair of foldable elements; and wherein a second of the cross braces is movably coupled to the first and second long arches such that the moon chair collapses in a movement in which the first and second long arches approximate each other when the first and second cross braces approximate each other.

11. The collapsible chair of claim 10 wherein each of the foldable elements comprises a first and a second rod.

12. The collapsible chair of claim 11 wherein each of the first rods is pivotably coupled to the first and second long arches, respectively.

13. The collapsible chair of claim 12 wherein each of the second rods is slidably and pivotably coupled to the first of the cross braces.

14. The collapsible chair of claim 13 further comprising a first and second element coupled to the first and second long arches and cooperating to form a handle with which the chair is carried when the chair is in a closed configuration.

* * * * *